US006796876B2

(12) United States Patent
Luk

(10) Patent No.: US 6,796,876 B2
(45) Date of Patent: Sep. 28, 2004

(54) BREAST CUP FOR A BRA WITH VISUAL ENHANCEMENT

(75) Inventor: Theone Luk, Kwai Chung (HK)

(73) Assignee: Regina Miracle International Limited, Hong Kong (HK)

( * ) Notice: Subject to any disclaimer, the term of this patent is extended or adjusted under 35 U.S.C. 154(b) by 0 days.

(21) Appl. No.: 10/349,513

(22) Filed: Jan. 21, 2003

(65) Prior Publication Data

US 2004/0142631 A1 Jul. 22, 2004

(51) Int. Cl.[7] ..... A41C 3/00
(52) U.S. Cl. ..... 450/39; 450/57; 2/267
(58) Field of Search ..... 450/54–57.1, 39, 450/44, 47, 49, 51, 52, 90, 92, 93; 156/245; 264/257, 258, 291, 292, 294, 320, 321, 145, 148, 152–155, 157, 160, 163; 2/267, 268, 244, 246

(56) References Cited

U.S. PATENT DOCUMENTS 2,541,147 A * 2/1951 Becker ..... 450/51
5,733,335 A * 3/1998 Ishikawa et al. ..... 623/7
5,967,877 A * 10/1999 Howard ..... 450/57

* cited by examiner

*Primary Examiner*—Gloria M. Hale
(74) *Attorney, Agent, or Firm*—Ostrolenk, Faber, Gerb & Soffen, LLP

(57) ABSTRACT

In a brassiere, a breast cup of a molded single or multi-ply cup shaped panel having a perimeter which includes an edge which when the breast cup forms part of a brassiere, is a free perimeter edge, the free perimeter edge has piping engaged thereto.

12 Claims, 4 Drawing Sheets

BREAST CUP FOR A BRA WITH VISUAL ENHANCEMENT

FIELD OF THE INVENTION

The present invention relates to decorative edging and embellishment for a breast cup for a brassiere.

BACKGROUND OF THE INVENTION

The construction of a brassiere (herein after referred to as "bra") consists of many components and the assemblage of these components into a final product is time consuming. The assembly process is often the most time consuming of the manufacturing process and is the biggest singular cost component. Thus any reduction at this stage is of an advantage.

The aesthetic appeal is also an important consideration in the production of a bra, and is often the most important aspect in the purchasing decision made by a potential purchaser. From a marketing point this is the biggest product differentiator.

However the two aspects of cost of construction and aesthetics are competing components and traditionally at odds with one another. Technology and improvements in design and machinery are allowing the components to be combined and a cost advantage to be realised.

Aesthetic appeal can be applied to breast cup constructions by the application of edging and embellishment. In particular it is recognised that an aesthetically appealing cup (and hence bra) construction can be realised to the outer regions or free edges of the cup. The "free edges" of the cup being those that are not attached to other components of the bra. Such includes the top cup edge the appearance of which can benefit from such a treatment as this may at times be visible to others.

It is therefore an object of the present invention to provide to a breast cup of or for a bra construction, that goes at least some way to providing the above desiderata or at least gives the public a useful choice.

BRIEF DESCRIPTION OF THE INVENTION

In a first aspect the present invention consists, in or for a brassiere, a breast cup of a molded single or multi-ply cup shaped panel having a perimeter which includes an or part of an edge (hereinafter "free edge") which when said breast cup forms part of a brassiere, is a free perimeter edge, said free perimeter edge having engaged thereto a piping.

Preferably said piping includes a core of an elongate flexible member about which a thread is provided.

Preferably said thread is provided about said core in an overlooking manner.

Preferably said piping extends at least in part along at least part of said free edge.

Preferably said piping extends at least in part outwardly of and adjacent to at least part of said free edge.

Preferably said piping extends at least in part along at least part of said free edge and said stitching extends about said elongate flexible member and through said panel securing said piping to at least part of said free edge.

Preferably said stitching is overlocked to at least part of said free edge and captures said elongate member within said stitching and against said at least part of said free edge.

Preferably said piping extends at least in part outwardly of and adjacent to at least part of said free edge and is engaged to said free edge at at least one region thereof.

Preferably said piping extends along two regions of said free edge, wherein intermediate of said two regions said piping extends outwardly of said free edge.

Preferably said piping includes a core of an elongate flexible member about which a thread is provided, said thread stitching through said panel to capture said elongate member at said two regions against said panel along said free edge and about said elongate member intermediate of said two regions.

Preferably the thread of said piping extends onto the panel of said cup away from said free edge to define embroidery on the outward face of said panel.

Preferably said thread is stitched to said panel of said cup away from said free edge and without the elongate member being provided thereto.

Preferably said elongate flexible member is a tube of plastic.

Preferably said piping extends along the entire free edge or edges of said cup.

In a second aspect the present invention consists in a brassiere which incorporates two breast cups with at least one breast cup being as herein before defined.

In a further aspect the present invention consists in a method of enhancing the edge detailing of a breast cup of a kind which is or is to form part of a brassiere and is made of a molded single or multiply cup shaped panel having a perimeter which includes an edge or part of an edge (herein after "free edge") which when said breast cup forms part of a brassiere, is a free perimeter edge, said method comprising;

(a) engaging to said cup at or proximate to said free edge an elongate flexible member in a manner such that said elongate flexible member extends at least in part along or from at least part of said free edge (b) providing a thread about said elongate flexible member over a substantial portion of its length to capture said elongate flexible member in a sheath like manner.

Preferably said elongate flexible member is tacked to said cup prior to said thread engaging thereabout.

Preferably the providing of thread about said flexible elongate member also stitches said thread and said flexible elongate member to said cup.

Preferably said providing of said thread about said flexible elongate member in at least one region there along does not stitch said thread with said flexible elongate member to said cup.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

BRIEF DESCRIPTION OF THE DRAWINGS

FIG. 1A or 1B is provided ready to be molded between the upper and lower mould members.

DETAILED DESCRIPTION OF THE INVENTION

Figure 6:
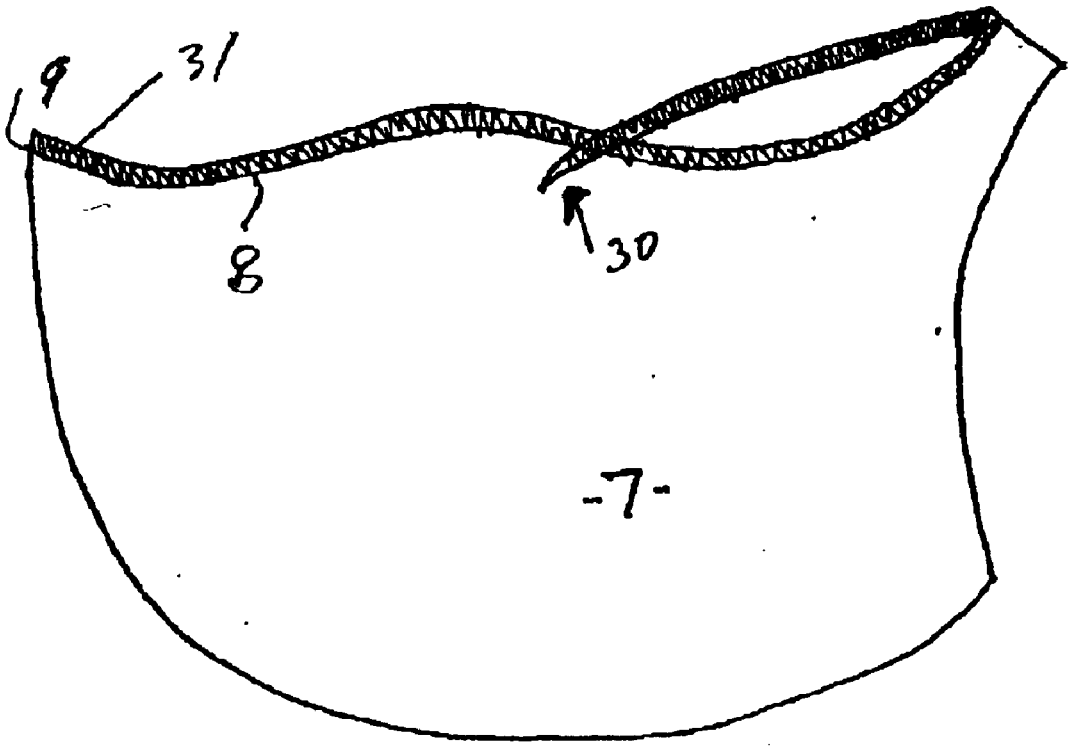
FIG. 6 is a view similar to FIG. 5A of the finished product.

A breast cup construction embellished by the provision of a piping or embroidery about a free edge thereof is provided and as shown for example in FIG. 6. The embellishment may be provided to a breast cup of any kind however for the purposes of providing a low cost of manufacture breast cup and/or bra incorporating the breast cup, the applicant has also developed a breast cup construction to which brief reference will firstly be made.

Figure 1A:
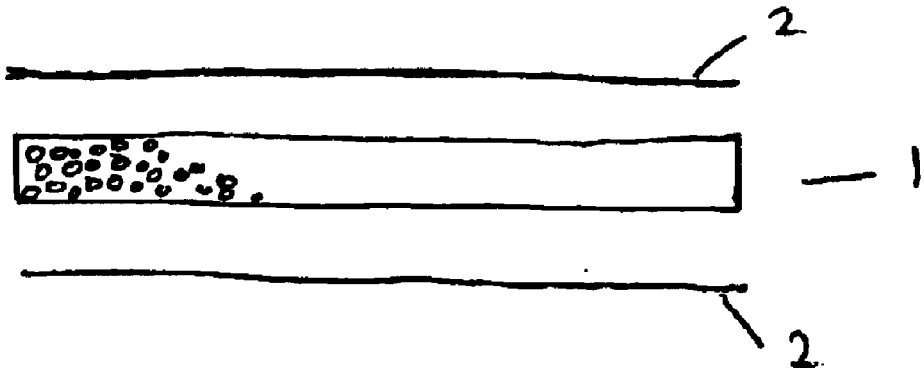
FIG. 1A is a sectional and exploded view of the layers of a breast cup construction in one form of the present invention showing a single foam layer core and two overlying layers of fabric for laminating onto the core.
Figure 1B:
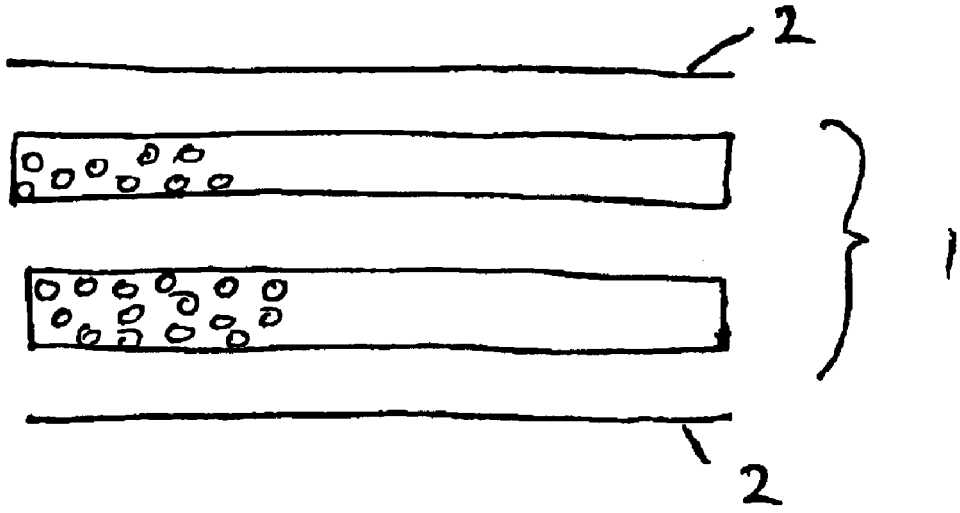
FIG. 1B is a sectional and exploded view of the layers of a breast cup construction of another form of the present invention wherein two foam core layers are provided each to be overlayed with a fabric material on each side of such core.
Figure 2:
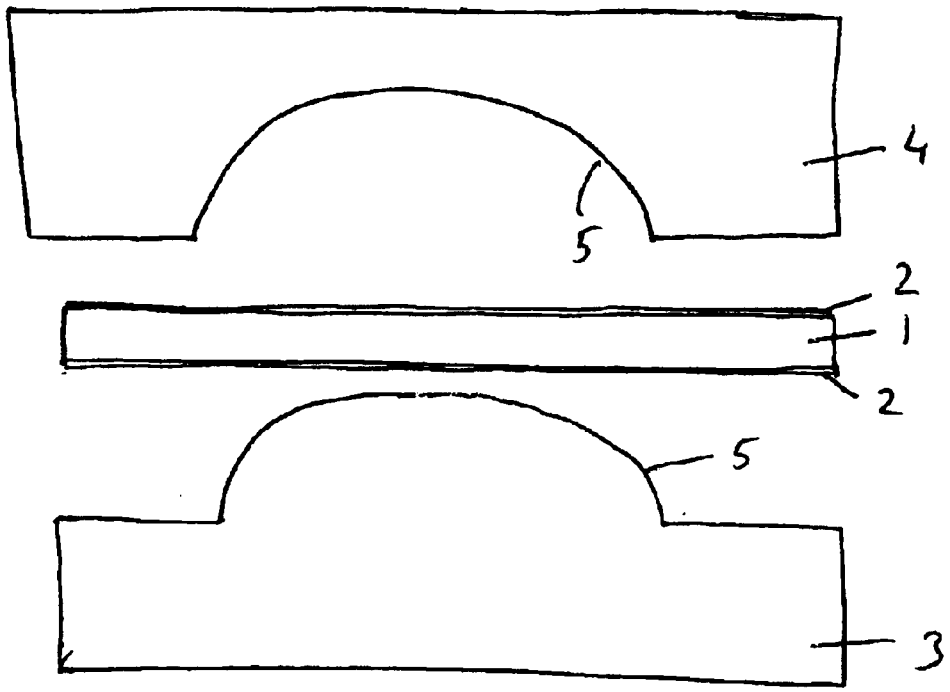
FIG. 2 is a sectional view through a moulding machine illustrating upper and lower mould members intermediate of which an assemblage as for example
Figure 3:
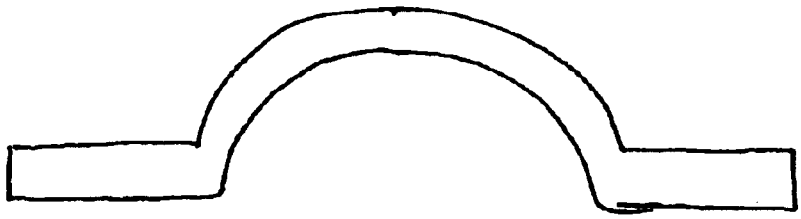
FIG. 3 illustrates the layers having been molded to define a three dimensional cup shape to be utilised in the construction of a bra.
Figure 4:
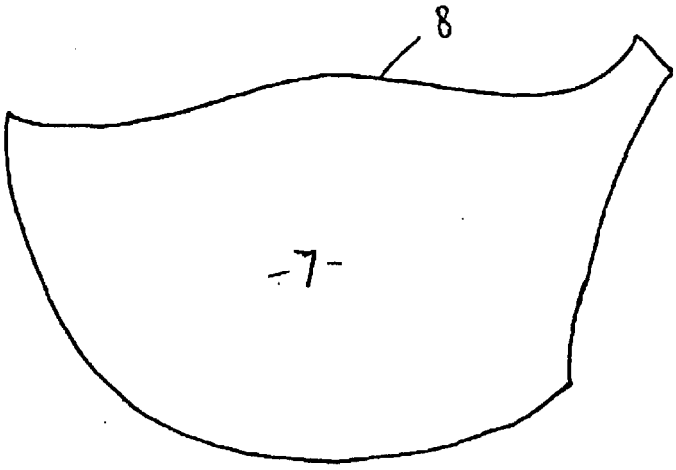
FIG. 4 is a plan view of such a three dimensional cup shape illustrating the perimeter region having been cut manufactured (whether by cutting or by moulding or by heat separation) to define an appropriate perimeter form.

With reference to FIGS. 1A and 1B, the breast cup construction will consist of a core layer or layers 1 made of a foam material. The foam material is for example an open cell polyurethane foam.

The core is laminated to layers of fabric material on each side thereof. The fabric material 2 is preferably a polyester based nylon or similar material which is of a woven kind. The layer of fabric material is adhered to the core by the use of a suitable adhesion process. In the most preferred form, adhesion is achieved by a heating of the layers which will melt or partially melt the material to thereby form bonding between the layers. Alternatively or additionally an adhesive may also be used. Moulding of each layer onto an adjacent layer preferably occurs individually. For example in the configuration of FIG. 1B, the two core layers are firstly laminated together whereafter the fabric layers are laminated onto the prior formed core. Lamination of the layers occurs in a manner which also introduces the three dimensional form to the layers. Laminating hence does not occur whilst the layers are in a flat condition but occurs simultaneously to the deformation of the layers to a three dimensional cup shape. Accordingly the use of a moulding device is required. The moulding device consists of a lower mould 3 and upper mould 4. The upper and lower moulds include relief features 5 which are substantially complimentary shaped. The relief features are of a shape to define three dimensional cup form to the layers of material. The mould portions also include heating provisions which will heat the mould to thereby heat the layers of material during the moulding process. After the lamination of all of the layers of the cup construction together, the cup construction will maintain a three dimensional cup form.

The embellishment or visual enhancement of a breast cup for the present invention is achieved by the stitching of thread to at least part of the free edge or edges of the breast cup construction. The provision of stitched thread for the embellishment is preferably by the use of the technique called "overlooking". However in addition to overlooking the thread to the edge where such embellishment is to be provided, a flexible soft member is provided as a bulking means. It is about this flexible soft plastic elongate member which the overlocking of the thread occurs.

In a bra, the uppermost edge of the breast cup is normally a free edge which can benefit from visual enhancement since such a free edge can at times be visible to other persons other than the person wearing the bra. Any visual enhancement to such an edge will make the bra more appealing both to the person wearing the bra and to others. The visual enhancement or embellishment of the present invention may however also be provided to other perimeter regions of the breast cup or to at least part of the perimeter or edges of a breast cup.

Figure 5A:
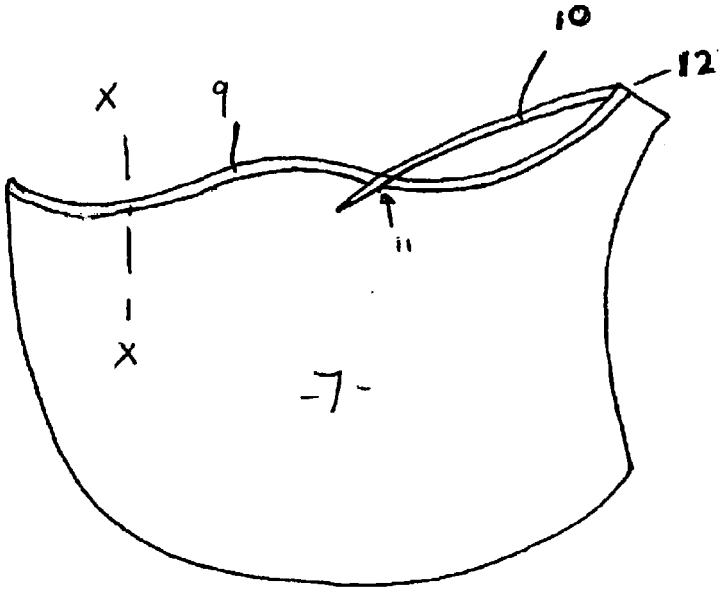
FIG. 5A is a plan view of the breast cup construction of FIG. 4 wherein the upper free edge and part of the cup interior of the cup construction has been embellished by the provision of piping.
Figure 5B:
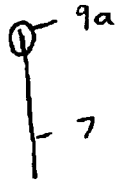
FIG. 5B is a side view of the cup of FIG. 5A along line X—X showing the piping in relation to the cup.

The breast cup 7 at its free upper edge 8 for example, may have engaged thereto a soft plastic strip, tape or tube 9. With reference to FIG. 5B, which is a sectional view through section X—X of FIG. 5A, a split tube 9*a* is shown engaged to the edge of the breast cup. The upper edge of the breast cup 7 is inserted into the tube through this elongate split of the tube.

Alternatively a plastic strip may be provided to one of the surfaces of the breast cup immediately adjacent to the edge 8. The soft plastic strip, tape or tube is manually or machine engaged to the edge at tack points so as to securely fix the strip or tube at such locations to the cup. Such tacking of the strip or tube to the edge of the breast cup occurs prior to the overlooking step. Such manual or machine fixing of the strip or tube to the edge of the breast cup may be achieved by an adhesive or by stapling or by heat welding or by stitching. The points at which the strip or tube is tacked onto the edge of the cup, is such that the tube substantially follows the edge of the cup at which it is engaged. The overlooking step of the manufacturing process occurs next and involves the use of a sewing machine as shown in FIG. 6, to overlock the plastic strip tape or tube 9 along substantially its entire length so as to provide a thread 31 thereabout which substantially entirely covers the strip or tube 9. The overlooking will also result in the stitching of the thread to the material of the cup 7 at a location inwardly but immediately adjacent to the edge 8 of the cup. The width of overlooking is of a narrow kind and is substantially only sufficient to encompass the plastic strip or tube and to penetrate through the material of the breast cup. The resultant appearance of the strip or tube is that which it visually looks like piping provided to the edge of the breast cup. Such piping has an embroidered appearance as a result of the high density overlooking stitching which is provided.

In effect the thread 31 which is provided about the flexible member or tube 9 is of such a high density so as to provide a sheath about that elongate member. The elongate member is captured within effectively a sheath which is defined by the thread of where the enhancement runs along the free edge of the cup, the thread by being stitched to the cup will also capture the elongate member against the cup at or substantially adjacent the free edge 8.

With the selection of an appropriate colour, the piping appearance can be clearly distinguished from the breast cup construction.

The stitching may also extend onto the body of the cup as at for example region 30. Where such stitching which may be a continuation of the edge embroidery, the plastic strip need not be provided.

As a further embellishment for a breast cup construction, the piping appearance may also be provided to extend and to be at least in part separated from the breast cup construction. With reference to FIG. 5, a plastic tube or strip 10 which may be a continuation of the plastic tube or strip 9 from the free edge or may be a separate length of plastic, is provided to extend from and to be at least in part separated from the free edge 8 of the breast cup 7. The tube or strip 10 is able to be tacked onto the breast cup at at least two locations 11 and 12 so that at least at or towards its distal ends, it makes contact with the breast cup. Intermediate of the tack points 11 and 12, the tube is free from the breast cup. A gap between the breast cup and the tube intermediate of the tack points 11 and 12 is provided. Overlocking about the tube or strap 10 in a similar manner to that of the strip or tube 9 can be provided by a sewing machine. The strip or tube 10 may also extend onto the breast cup and overlooking or stitching may continue towards the end of the strip or tube 10 extending onto the breast cup and beyond. Alternatively stitching from the "free piping" may continue to extend onto the cup body without the strip or tube. The "free piping" appearance provided by the overlooking about the strip or tube 10 provides additional embellishment to the appearance of a breast cup construction or bra incorporating such a feature.

With the use of computer aided sewing, the shape of the cup and the pattern to be formed thereon and or the exterior band or strip can be loaded into the software controlling the computerised sewing machine. The software then is able to control and drive the sewing machine to provide the overlocking stitching about the soft plastic strip or tube to form the desired embellishment.

The aesthetic appeal of the cup, and hence final bra product, is improved. Also the wear characteristics of the piped free edge are improved. The edging applied reinforces the free edge and prevents fraying of the material components or delamination of the construction layers of the cup. Furthermore the addition of a low elasticity component to the piping prevents stretching of the upper region of the cup parallel to the skin of the wearer.

Another advantage is realised when it is considered that the construction of components for a bra has the potential for outsourcing. By making the component unitary with no free edges handling, shipping and storage of cups for incorporating into bras at a later stage are greatly simplified.

The present invention may be embodied in other specific forms without departing from the spirit or essential attributes thereof and accordingly reference should be made to the appended claims rather than the foregoing specification as indicating the scope of the invention.

What is claimed is:

1. A breast cup for a brassiere, the cup comprising a molded cup shaped panel, the panel having a perimeter which includes a free perimeter edge when the breast cup forms part of a brassiere, piping engaged to the free perimeter edge, the piping including a core of an elongate flexible member and a thread provided about the core in an overlooking manner and holding the piping to the panel.

2. A breast cup as claimed in claim 1 wherein the piping extends at least in part along at least part of the free perimeter edge.

3. A breast cup as claimed in claim 1, wherein the piping extends at least in part outwardly of and adjacent to at least part of the free perimeter edge.

4. A breast cup as claimed in claim 1 wherein the piping extends at least in part along at least part of the free perimeter edge and the thread comprises stitching extending about the elongate flexible member and through the panel thereby securing the piping to at least part of the free edge.

5. A breast cup as claimed in claim 1 wherein the piping extends at least in part outwardly of and adjacent to at least part of the free perimeter edge and is engaged to the free perimeter edge at at least one region of the free perimeter edge.

6. A breast cup as claimed in claim 1 wherein the panel free perimeter edge includes two separated regions along the edge, and an intermediate region between the two regions, the piping extending along the two regions of the free perimeter edge, and at the intermediate region the piping extending outwardly of the free perimeter edge.

7. A breast cup as claimed in claim 6 wherein the piping includes a core of an elongate flexible member about which the stitching including a thread is provided, the thread being stitched through the panel to capture the elongate member at the two regions and against the panel along the free perimeter edge and about the elongate member at the intermediate region.

8. A breast cup as claimed in claim 1 wherein the panel has an outward face;

a thread of the piping extending onto the panel of the cup away from the free perimeter edge to define embroidery on the outward face of the panel.

9. A breast cup as claimed in claim 1, wherein the piping extends along the entire free perimeter edge of the cup.

10. A brassiere which incorporates two breast cups wherein at least one breast cup is as claimed in claim 1.

11. A breast cup for a brassiere, the cup comprising a molded cup shaped panel, the panel having a perimeter which includes a free perimeter edge when the breast cup forms part of a brassiere, piping engaged to the free perimeter edge, the piping including a core of an elongate flexible member and a stitching of thread overlooked to at least part of the free perimeter edge and capturing the elongate member within the stitching and against the at least part of the free edge.

12. A breast cup for a brassiere, the cup comprising a molded cup shaped panel, the panel having a perimeter which includes a free perimeter edge when the breast cup forms part of a brassiere, piping engaged to the free perimeter edge, the piping including a core of an elongate flexible member and a and stitching holding the piping to the panel, the elongate flexible member is a tube of plastic.

* * * * *

UNITED STATES PATENT AND TRADEMARK OFFICE

CERTIFICATE OF CORRECTION

PATENT NO. : 6,976,876 B2
APPLICATION NO. : 10/349513
DATED : September 28, 2004
INVENTOR(S) : Theone Luk It is certified that error appears in the above-identified patent and that said Letters Patent is hereby corrected as shown below:

In column 1, line 52, change “overlooking” to - -overlocking- -

In column 4, line 4, change “overlooking” to - -overlocking- -

In column 4, line 32, change “overlooking” to - -overlocking- -

In column 4, lines 42-43, change “overlooking” to - -overlocking- -

In column 4, line 45, change “overlooking” to - -overlocking- -

In column 4, line 52, change “overlooking” to - -overlocking- -

In column 5, line 17, change “overlooking” to - -overlocking- -

In column 5, line 22, change “overlooking” to - -overlocking- -

In claim 1, column 6, lines 1-2, change “overlooking” to - -overlocking- -

In claim 11, column 6, line 45, change “overlooked” to - -overlocked- -

Signed and Sealed this

Twenty-second Day of August, 2006

JON W. DUDAS
*Director of the United States Patent and Trademark Office*